US005118063A

United States Patent [19]

Young, Sr.

[11] Patent Number: 5,118,063

[45] Date of Patent: Jun. 2, 1992

[54] CONCESSION TRAY

[76] Inventor: John R. Young, Sr., 11126 W. 121st St., Overland Park, Kans. 66203

[21] Appl. No.: 614,391

[22] Filed: Nov. 16, 1990

[51] Int. Cl.[5] ..... A47C 7/62

[52] U.S. Cl. ..... 248/311.2; 297/194

[58] Field of Search ..... 248/311.2, 310, 312.1, 248/314, 146, 149, 152, 176; 108/25, 26; 297/161, 194; 211/71, 126; D7/553, 554; 220/23.8, 23.83, 85 H, 475; 206/515, 503, 562, 563

[56] References Cited

U.S. PATENT DOCUMENTS

| | | | |
|---|---|---|---|
| 1,544,972 | 7/1925 | Gebelein | 220/23.8 |
| 1,757,689 | 5/1930 | Strickland | 206/562 |
| 2,801,066 | 7/1957 | Clare | 248/314 |
| 3,162,344 | 12/1964 | Sabol | D7/553 |
| 3,186,673 | 6/1965 | Olson . | |
| 3,498,470 | 3/1970 | Thomas | D7/553 |
| 3,675,969 | 7/1972 | Gage . | |
| 3,955,672 | 5/1976 | Brundage | 206/562 |
| 4,003,598 | 1/1977 | Glaze . | |
| 4,575,149 | 3/1986 | Forestal et al. . | |
| 4,591,206 | 5/1986 | Pribble . | |
| 4,795,211 | 1/1989 | Stern | 248/311.2 |
| 4,798,413 | 1/1989 | Capelli . | |
| 4,811,860 | 3/1989 | Sorenson | 206/515 |
| 4,863,134 | 9/1989 | Young et al. . | |

FOREIGN PATENT DOCUMENTS

| | | | |
|---|---|---|---|
| 968761 | 6/1975 | Canada | 211/71 |

*Primary Examiner*—Ramon O. Ramirez
*Assistant Examiner*—Robert A. Olson
*Attorney, Agent, or Firm*—Wm. Bruce Day

[57] ABSTRACT

A concession tray for carrying beverages and snacks from a concession sales area to a stadium or theater seat. The concession tray is made of light, inexpensive paper stock or plastic and includes downwardly extending cup receptacles sized for receipt into a chair arm cup-holder. The cup receptacles have multiple internal shoulders for receiving and holding different sizes of cups. The tray cup receptacles preferably include left, center and right receptacles for left, center or right mounting on the chair arm. A downwardly depending leg spaced from the cup receptacles maintains the tray level for loading with concession food and beverages. The tray is configured for stacking with the cup receptacles and legs fitting into matching cavities.

4 Claims, 2 Drawing Sheets

Fig. 3
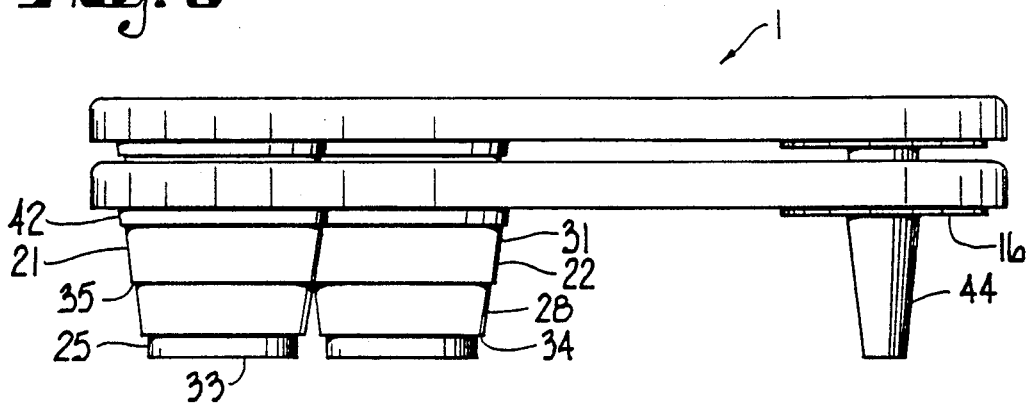
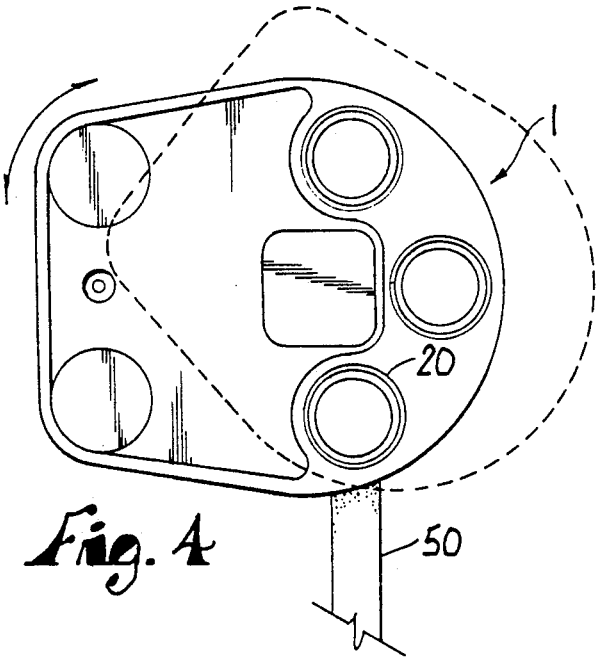
Fig. 4
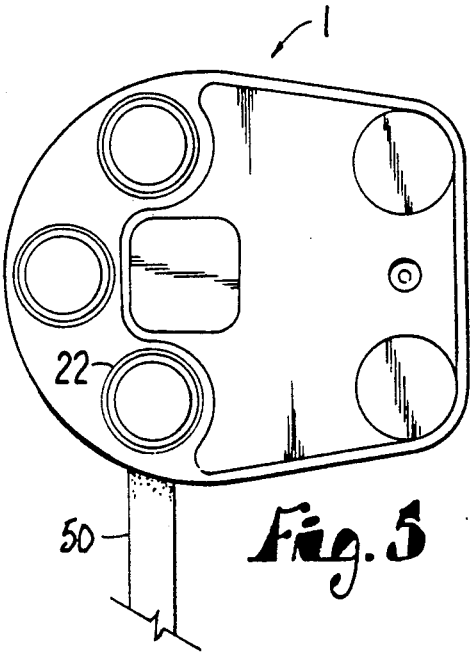
Fig. 5
Fig. 6
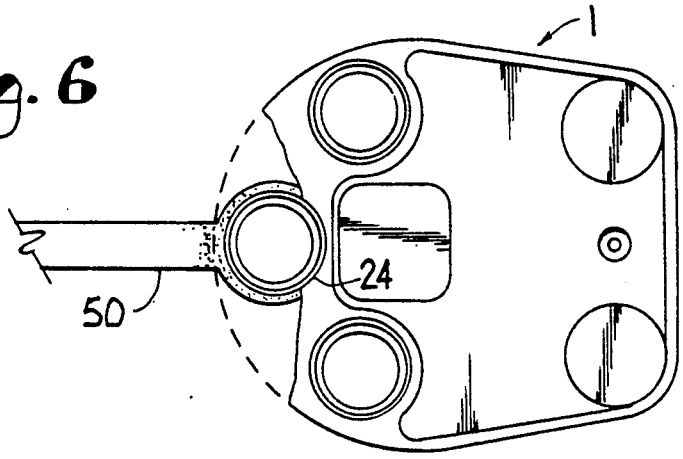

CONCESSION TRAY

FIELD OF THE INVENTION

This invention relates to attachments for chair arms in general and particularly to trays attachable to chair arms for holding food and beverages.

BACKGROUND OF THE INVENTION

Today's movie theaters and stadiums, as examples of the premier public entertainment attractions, draw a great number of viewers throughout the year. Many spectators find that the pleasure of viewing the event is enhanced by consuming refreshments, such as candy, popcorn, hot dogs, beer and soft drinks of various sizes. These refreshments often comprise a major source of revenue for the event and indeed, the concession sales may be the difference between profit and loss for the event. Often the viewer becomes tired of holding the drinks in his or her hands and may find holding the soft drink cumbersome when also trying to eat popcorn, candy or hot dogs. Thus, the drink must be set down on the floor where it may be accidentally kicked over and spilled, or on the chair arm where it may easily be knocked over. The juggling of these refreshments is often frustrating and may detract from the enjoyment of the film or event, as well as being a potential hazard to adjoining viewers. Additionally, if the viewer had a easy or handy way of carrying more concession goods back to his or her seat, it is believed that the viewer might well buy more goods. It is foreseeable that if the viewer had a tray to carry back food items and drinks, that the viewer might buy sufficient items to fill up the tray.

Because of these conditions, it is desirable to have available to the spectator a tray on which to carry food and beverages and on which the beverage would be held securely and not precariously balanced on the tray. It is also desirable that the tray be secured in some manner to the seat so that it can not easily be knocked over and so that it is available to the spectator and his or her companion. Preferably, the tray is fashioned to accommodate the placement of various sizes of beverage containers, with the tray stable and relatively immobile once mounted to the chair so as to prevent dislodgement by inadvertent movement.

OBJECTS OF THE INVENTION

The principle objects of the present invention are: to provide such a tray which receives various sizes of standard cups; to provide such a tray which maintains various sizes of beverage cups within easy grasp of the chair occupant while maintaining stability of the cup; to provide such a tray which is easily and inexpensively manufactured for disposal or reuse; to provide such a tray which is mountable to a receptacle in a chair arm; to provide such a tray which can be mounted in various positions, such as left, right and center on the chair arm for use by occupants of adjoining seats; to provide such a tray which can sit level on a surface, such as a concession stand counter for loading with food and beverages; to provide such a tray which can be stacked for storage and/or reuse; and to provide such a tray which is relatively simple to use, economical to manufacture and particularly well-adapted for the proposed usages thereof.

Other objects and advantages of this invention will become apparent from the following description taken in conjunction with the accompanying drawings, wherein are set forth by way of illustration and example certain embodiments of this invention.

SUMMARY OF THE INVENTION

A concession tray is comprised of a planar tray having an upper surface for retaining concession goods and including at least one downwardly depending receptacle for receiving and holding a cup. The receptacle extends perpendicularly to the tray and outwardly of the bottom surface of the tray and forms a truncated, conical boss. Preferably, there are three downwardly depending receptacles, left, center and right mounted, which frictionally and rotatably mount into a seat arm cup receptacle in left, center and right positions. The truncated conical cup receiver boss is receivable in a matching configuration conical socket in the chair arm and is joined thereto by a friction fit for toolless ease of connection and disconnection.

The drawings constitute a part of this specification and include exemplary embodiments of the present invention and illustrate various objects and features thereof.

BRIEF DESCRIPTION OF THE DRAWINGS

FIG. 3 is a side elevational view showing two concession trays in stacked relationship.

FIG. 4 is a top plan view showing the concession tray attached to a chair armrest and in a left swung position.

FIG. 5 is a top plan view showing the concession tray in a right swung relationship and attached to a chair arm.

FIG. 6 is a top plan view showing the concession tray attached to a chair arm and in a center position.

DETAILED DESCRIPTION OF THE INVENTION

Figure 1:
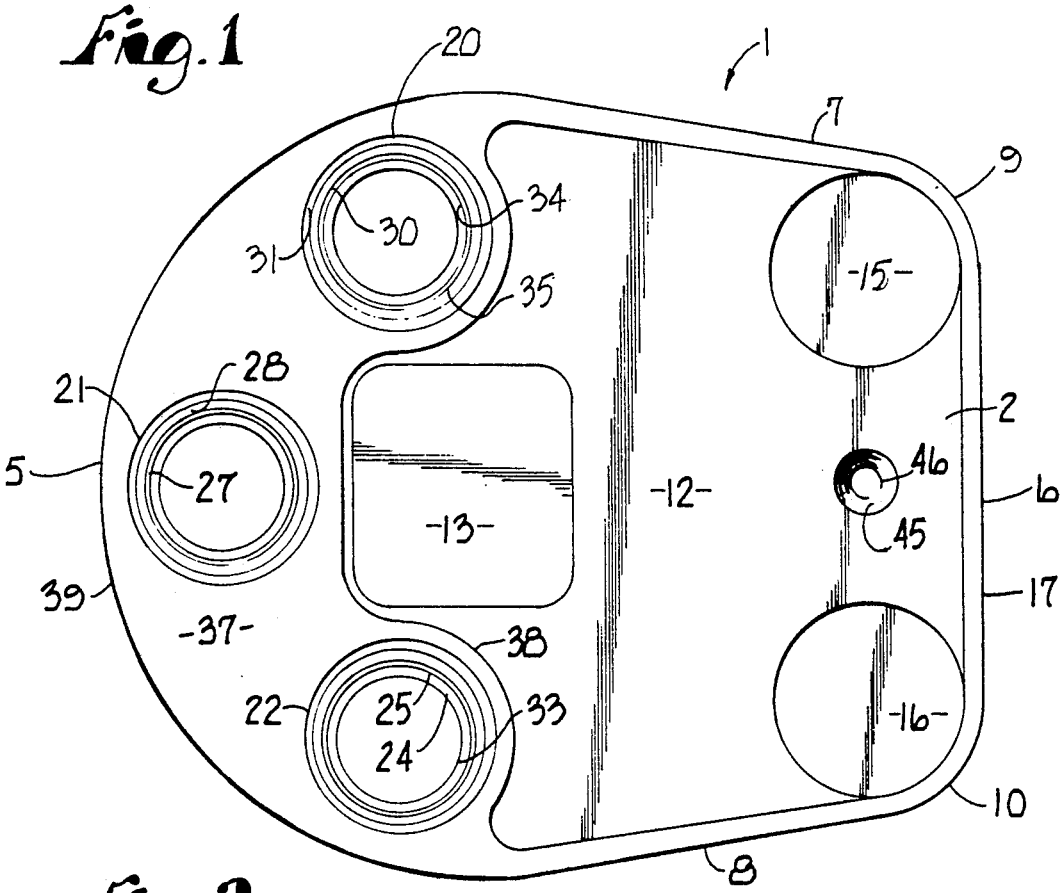
FIG. 1 is a top plan view of a concession tray embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawing in more detail:

The reference numeral 1, FIG. 1, generally indicates a concession tray embodying the present invention. The concession tray 1 is generally planar and has an upper surface 2 and a lower surface 3. Referring to FIG. 1, the concession tray 1 has a left or rearward side 5 and a forward side 6 with opposite margins 7 and 8. The tray 1 is generally rectangular in overall configuration with the rearward side 5 forming a radius curve, and corners 9 and 10 between the margins 7 and 8 and the forward side 6 are also radiused curves.

Figure 2:
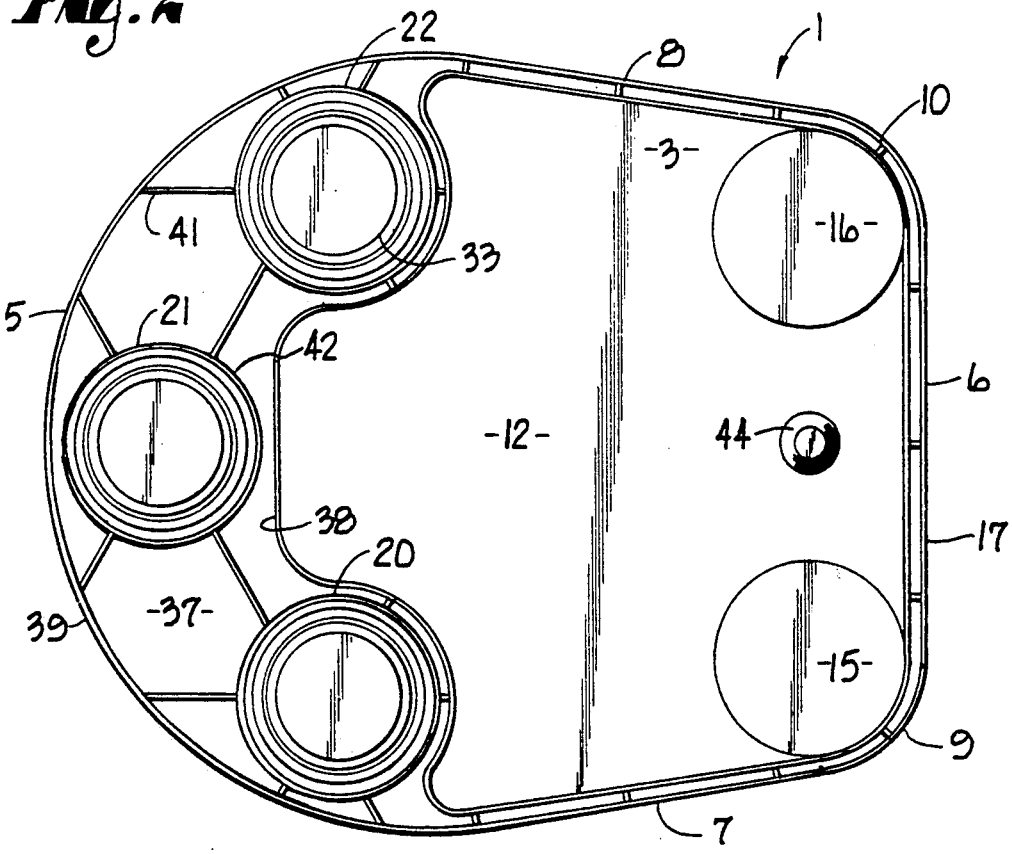
FIG. 2 is a bottom plan view of the concession tray.

In the example shown in FIGS. 1 and 2, the concession tray 7 has an indented portion 12 with a generally centrally located area 13 providing a logo space. Logo space 13 is generally the area in which a concession operator, stadium operator or a theater operator could place the company's logo by molding, embossing or vinyl or paper overlay. At the corners 9 and 10 are respectively positioned circular indentations 15 and 16 for receiving cups containing beverages. The circular indentations 15 and 16 are shallow, such as ⅛ inch deep relative to the indented portion 12. An upraised rim 17 extends about the periphery of the indented portion 12 and aids in keeping goods from sliding off of the tray 1 or liquid spillage from running off the tray.

Generally at the rearward side 5 are a plurality of downwardly depending cup receptacles extending perpendicularly to the tray 1 and outwardly of the lower surface 3. In the illustrated example, there are three such cup receptacles, including a left receptacle 20, center receptacle 21 and right receptacle 22. Each cup receptacle 20, 21, and 22 defines three coaxial bores: an inner or first bore 24, defined by a first wall 25, a middle bore 27 defined by a middle wall 28, and an outer bore 30 defined by an outer wall 31. The coincidental axis of the bores 24, 27 and 30 passes through the center of the bores and is generally vertical. A closed bottom 33 terminates the inner bore 24 and annular rings 34 and 35 form steps or shoulders between the inner bore 24 and the middle bore 27 and between the middle bore 27 and the outer bore 30. The outer bore 30 has a diameter that is greater than the diameter of the middle bore 27 which in turn has a diameter that is greater than the diameter of the first or inner bore 24, as is evident from the drawings. Thus, various sizes of cups can be accommodated by the cup receptacles 20, 21 and 22. The walls 25, 28 and 31 extend perpendicularly and downwardly of the tray 1 and form truncated, frusto-conical bosses.

In order to increase the surface area of contact between the received cup and either the inner bore 24, middle bore 27 and outer bore 30. the surfaces of the bores 24, 27 and 30 slope toward the center axis. Preferably, the preferred angle of slope is in the range of two to three degrees from the vertical. The desired angle of the slope generally corresponds to an angle of slope prevalent in many beverage cups used in theaters, stadia and the like. It is envisioned that this angle could be varied to conform to a particular slope of subject cups sold at a particular establishment, depending upon the circumstances.

At the top of the receptacles 20, 21, and 22, and at the rearward side 5 of the concession tray 1, is generally a raised land area 37 which extends into the rim 17 at the margins 7 and 8. A wall 38 separates the raised land area from the indented portion 12 and a downturned flange 39 forms the margin at the rearward side 5. On the underside or lower surface 3, FIG. 2, strengthening webs 41 extend between the receptacles 20, 21 and 22 and various other structural elements. Additionally, strengthening rings extend about the receptacles 20, 21 and 22 at the confluence of the wall 31 with the upper surface 3.

Spaced from the rearward side 5 and extending downwardly from adjacently the forward side 6 is a conical leg 44, which in the illustrated example, is molded into the concession tray 1 and is formed with a wall 45 forming an inner conical cavity 46. The cavity 46 accords to the external configuration of the leg 44 for vertical stacking receipt and nesting, FIG. 3. Preferably, the length of the leg 44 is the same as the length of the cup receptacles 20, 21 and 22 so that the concession tray 1 maintains a level relationship when placed on a concession stand counter and loaded with food and beverages.

The concession tray 1 is constructed to nest with like concession trays 1, FIG. 3. Therein, the receptacles 20, 21 and 22 and leg 44 of each tray 1 nest inside the matching cavity formed by the receptacles 20 through 22 and leg 44 of the underlying concession tray 1.

The concession tray is designed to be used in conjunction with a cupholder armrest, such as disclosed in the inventor's U.S. Pat. No. 4,863,134, issued Sep. 5, 1989 and incorporated herein by reference. U.S. Pat. No. 4,863,134 discloses a combination cupholder and armrest for attachment to a chair arm, such as a chair arm in a stadium or theater seat. The cupholder portion of the armrest includes a cupholder receptacle which defines at least two coaxial bores, having two different diameters sized to receive a plurality of different sized cups. The cup receptacles 20, 21 and 22 of the concession tray 1 are sized and matched for snug frictional yet rotatable toolless fit and removal in the cupholder end of the armrest. As disclosed above, the instant concession tray 1 includes the three cupholders 20, 21 and 22, any one of which may fit into the cupholder of the armrest disclosed in the Young et al. ,134 patent. Thus, the concession tray 1 may be positioned so that the left receptacle 20 is mounted in the cupholder end of the armrest 50 so that it is swung to the left of the armrest, FIG. 4. Alternatively, the right cup receptacle 22 can be mounted in the armrest 50 so that it is swung to the right of the armrest 50 and over the lap of the person seated in the right side seat. Finally, the concession tray 1 may be center mounted with the center receptacle mounted in the armrest 50 so that it is substantially equally positioned between side by side seated companions.

It is foreseen that the material of construction may be either plastic with a tray of injection molded plastic or that the tray can be formed of pressed paper stock. In those situations, as in a movie theater, where trays may be collected and washed, it may be preferable to use plastic material. In those situations where it is not practicable to wash and reuse the tray 1, it may be more economical to construct the tray of molded paper stock. Particularly in sports stadia, it may be preferable to form the tray 1 of molded paper stock of low mass and light weight in order to reduce the opportunity for the tray 1 being thrown by unruly fans.

It is to be understood that while certain forms of the present invention have been illustrated and described herein, it is not to be limited to the specific forms or arrangement of parts described and shown except insofar as such forms and limitations are included in the following claims.

What is claimed and desired to be secured by Letters Patent is as follows:

1. In combination with a chair arm having an outwardly extending cup holder arm end, a concession tray comprising:

a) a planar tray having an upper surface with a mid portion for retaining concession goods, and with spaced front corners and a rear portion;

b) said rear portion having at least two spaced, downwardly depending receptacles at said corners for respectively receiving and holding cups, said receptacles extending perpendicularly to said tray and outwardly of a bottom surface of said tray and forming respective truncated, conical bosses:

c) said bosses being sized for selectively frictionally fitting into said cup holder arm end, whereby said concession tray is selectively mountable with respect to said chair arm for left or right positioning relative thereto.

2. The combination set forth in claim 1 wherein said planar tray has left, right, and middle receptacles depending downwardly therefrom for left, right, or centered mounting on said chair arm cup holder end.

3. The combination set forth in claim 1 wherein said planar tray has let means extending downwardly generally from said rear portion and spaced from said receptacles, said let means extending downwardly a substantially equal distance to the downward extension of said receptacles whereby said planar tray is maintained in a level attitude by said leg means and said receptacles when positioned upon a levell surface.

4. In combination with a chair arm having an outwardly extending cup holder arm end including a bore, a concession tray comprising:

a) a planar tray having an upper surface with a peripheral rim and with a mid portion for retaining concession goods, and with spaced front corners and a rear portion;

b) said rear portion having at least left, right and middle spaced, downwardly depending receptacles at said corners for respectively receiving and holding cups, said receptacles extending perpendicularly to said tray and outwardly of a bottom surface of said tray and forming respective truncated, conical bosses:

c) said bosses being sized for selectively frictionally fitting into said cup holder arm end bore, whereby said concession tray is selectively mountable with respect to said chair arm for left, right or centered positioning relative thereto.

* * * * *